US006412370B1

(12) United States Patent
Hsu et al.

(10) Patent No.: US 6,412,370 B1
(45) Date of Patent: Jul. 2, 2002

(54) STRUCTURE OF A SCREW-MOUNTING DEVICE

(76) Inventors: Ming-Chieh Hsu; Yue Kin Chu, both of 4972 Heritage Dr., Chino Hills, CA (US) 91709

( * ) Notice: Subject to any disclaimer, the term of this patent is extended or adjusted under 35 U.S.C. 154(b) by 0 days.

(21) Appl. No.: 09/759,782

(22) Filed: Jan. 16, 2001

(51) Int. Cl.[7] ..... B25B 23/04
(52) U.S. Cl. ..... 81/57.37; 81/435
(58) Field of Search ..... 81/57.37, 431, 81/433, 434, 435; 127/136

(56) References Cited

U.S. PATENT DOCUMENTS 5,855,151 A * 1/1999 Habermehl ..... 81/434

* cited by examiner

*Primary Examiner*—D. S. Meislin
(74) *Attorney, Agent, or Firm*—Ming-Chieh Hsu; Yue Kin Chu

(57) ABSTRACT

An improved structure of a screw mounting device comprising a machine body, a machine tubing, a controlling module and a retractable adjusting device located at one lateral side of the machine body, the end face of the front end of the machine body being a sloping side to allow a sliding wheel of the controlling module to urge against the sliding, the controlling module comprising a guiding rod, the sliding wheel and a cavity body and the controlling module located at the side of a screw insertion slot module, characterized in that the lateral side of the sliding rod is extended to provide a "Γ"shaped holding block, and the holding block is appropriately mounted at a recess located at the bottom section of the screw-pushing plate, the sliding wheel is pivotally mounted at the top section of the guiding rod, and the bottom section of the guiding rod is provided with a spring within the cavity body, thereby when the sliding wheel urgingly slides together with the sloping side, the guiding block is simultaneously moves upwards or downwards according to the sloping side, so that the holding block drives the sliding block to move upwards or downwards with the sliding slot, and therefore the screw-pushing plate can urge against the bottom section of the screw, and the screw is elevated until the screw rod is inserted for mounting.

1 Claim, 4 Drawing Sheets

STRUCTURE OF A SCREW-MOUNTING DEVICE

BACKGROUND OF THE INVENTION (a) Technical Field of the Invention

The present invention relates to an improved structure of a screw-mounting device, and in particular, to a device with simple structures which do not wear out or damage easily. The device of the present invention is easily assembled and can be easily and conveniently maintained.

(b) Description of the Prior Art

FIG. 1 shows a conventional screw-mounting device comprising a machine body A, a machine tubing B, and a controlling/pushing screw block module C, wherein the interior of the top section of the machine body A is provided with a spring A1, and the two lateral sides of the machine body A are provided respectively with a corresponding passage A2. The lower section of one lateral side of the passage A2 is provided with a sloping slot A3, and the sloping slot A3 allows the sliding of a triggering rod C2 of the controlling/pushing screw block C. One end of the spring A1 is connected to a mounting seat B1 at the rear end of the machine tubing B. The machine tubing B is protruded from the front end of the machine body A and the rear end is connected to the mounting seat B1 moveable along the path A2 such that the machine tubing B is retractable within the interior of the machine body A. The bottom section of the machine tubing B is provided with a screw block slot B2, allowing the insertion of a screw block C. One lateral side of the screw slot B2 is provided with a screw-pushing block B21. By means of the triggering rod C2 of the controlling pushing screw block module C, the screw block module C, the screw-pushing block B21 is triggered to cause screws of the screw block to be pushed to the center of the machine tubing B so as to wait for next mounting procedure. The controlling/pushing screw block module C comprises a connection seat C1, a triggering rod C2, and a sliding rod C3.

The connection seat C1 is connected to the lower section of the mounting seat B1 of the machine tubing B, and the top of the mounting seat B1 is provided with a spring ring C11. The spring ring C11 is connected to the triggering rod C2 which is"┘"a shaped, and the front end head is bent and is located within the screw-pushing block B21 of the screw block slot B2 to allow triggering. In addition, the other end (rear end) of the triggering rod C2 is horizontally connected to the sliding rod C3. The sliding rod C3 is extended to urge at the sloping slot A3 of the machine body A. Thus, when the machine tubing B moves backwards by a pulling force (as shown in FIG. 2), the mounting seat B1 is moveable along the passage A2, and at the same time, the connection seat C1 of the controlling/pushing screw block module C is driven to move backwards. When the connection seat C1 moves backwards, due to the shape of the sloping slot A3, the sliding rod C3 gradually slides to the sloping slot A3 and the front end of connected triggering rod C2 moves downwards such that the front end head of the triggering rod C2 drives the screw-pushing block B21 to move downwards. At this instance, the pushing plate B22 of the screw-pushing block B21 is driven to move downwards to urge at the bottom section of the screws of the screw block Additionally, when the mounting seat B1 moves forwards so as to be positioned, the triggering rod C2 moves in accordance with the sliding rod C3 and the front end head of the triggering rod C2 urges the screw-pushing block B21 to move upwards, and the pushing plate B22 causes the screw to move upwards. In the conventional screw-mounting device, the sliding rod C3 moves along the sloping slot A3 so as to drive the end head of the triggering rod C2 to drive the screw-pushing block B21 to move downwards, and the pushing plate B22 of the screw-pushing block B21 urges the bottom section of the screw of the screw block.

When the triggering rod C2 moves forwards with the sliding rod C3, the screw is moved upwards and the objective of screw pushing is attained. However, as the sliding rod C3 and the triggering rod C2 are connected, and the sliding rod C3 is urged at the sloping slot A3, after a period of use, the sliding rod C3 will erode the sloping slot A3 to form a recess which affects the smoothness of sliding movement. This will also affect the pushing of the screws. In addition, the sliding rod C3 is driven by the connection seat C1, and the connection seat C1 is connected to the lower section of the mounting seat B1, and the triggering rod C2 is bent, the end head is required to be extended at the screw-pushing block B21 of the screw block slot B2. Thus, with respect to the component, the conventional structure is too complicated and the assembly thereof is laborious and time consuming.

SUMMARY OF BE INVENTION

Accordingly, it is an object of the present invention to provide an improved structure of a screw-mounting device comprising a machine body, a machine tubing, a controlling module and a retractable adjusting device located at one lateral side of the machine body, the end face of the front end of the machine body being a sloping side to allow a sliding wheel of the controlling module to urge against the sliding movement, the controlling module comprising a guiding rod, the sliding wheel and a cavity body, and the controlling module located at the side of a screw insertion slot module, characterized in that the lateral side of the sliding rod is extended to provide a "⊢"shaped holding block, and the holding block is appropriately mounted at a recess located at the bottom section of the screw-pushing plate, the sliding wheel is pivotally mounted at the top section of the guiding rod, and the bottom section of the guiding rod is provided with a spring within the cavity body, thereby when the sliding wheel urgingly slides together with the sloping side, the guiding block is simultaneously moves upwards or downwards according to the sloping side, so that the holding block drives the sliding block to move upwards or downwards with the sliding slot, and therefore the screw-pushing plate can urge against the bottom section of the screw, and the screw is elevated until the screw rod is inserted for mounting.

Other object and advantages of the present invention will become more apparent from the following description taken in conjunction with the accompanying drawing.

DETAILED DESCRIPTION OF THE PREFERRED EMBODIMENT

Figure 1:
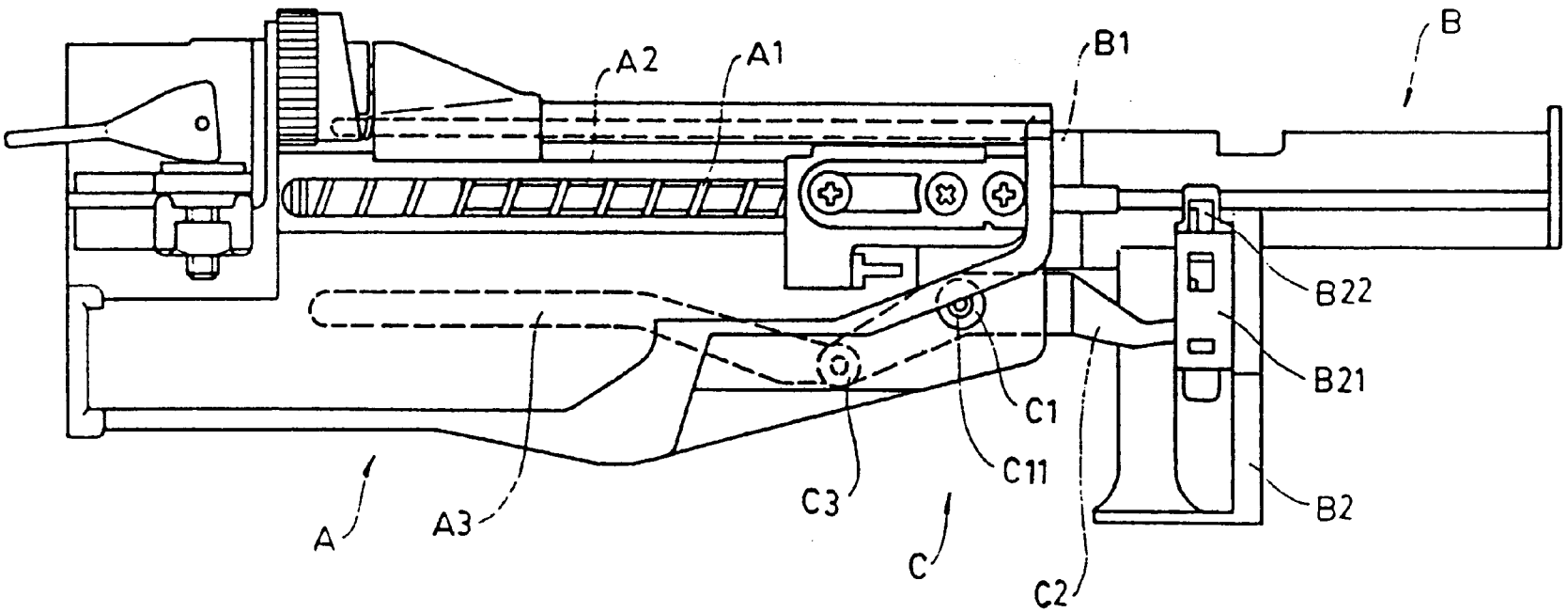
FIG. 1 is a sectional view of a conventional screw-mounting device.
Figure 2:
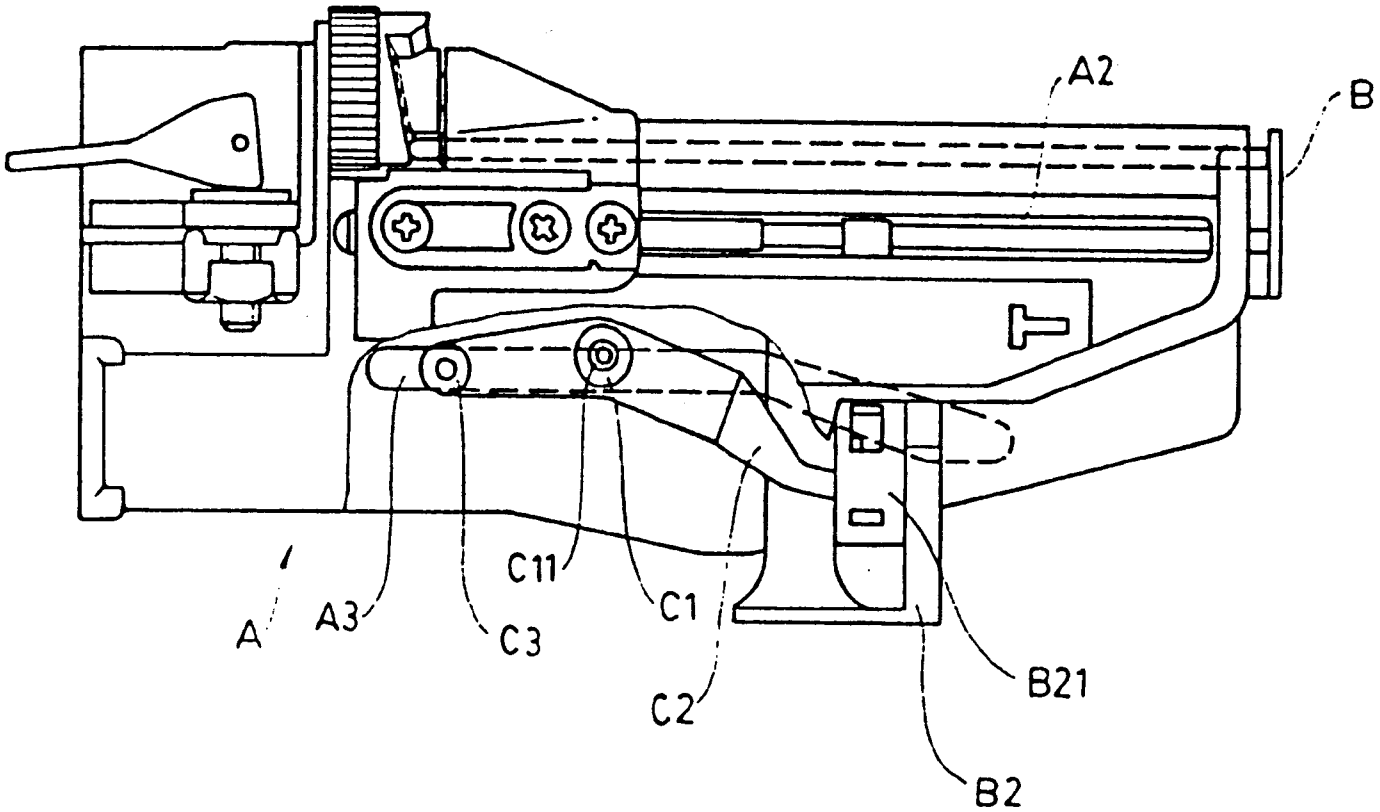
FIG. 2 is a sectional view showing the action of the pushing-controlling block of a conventional screw-mounting device.
Figure 3:
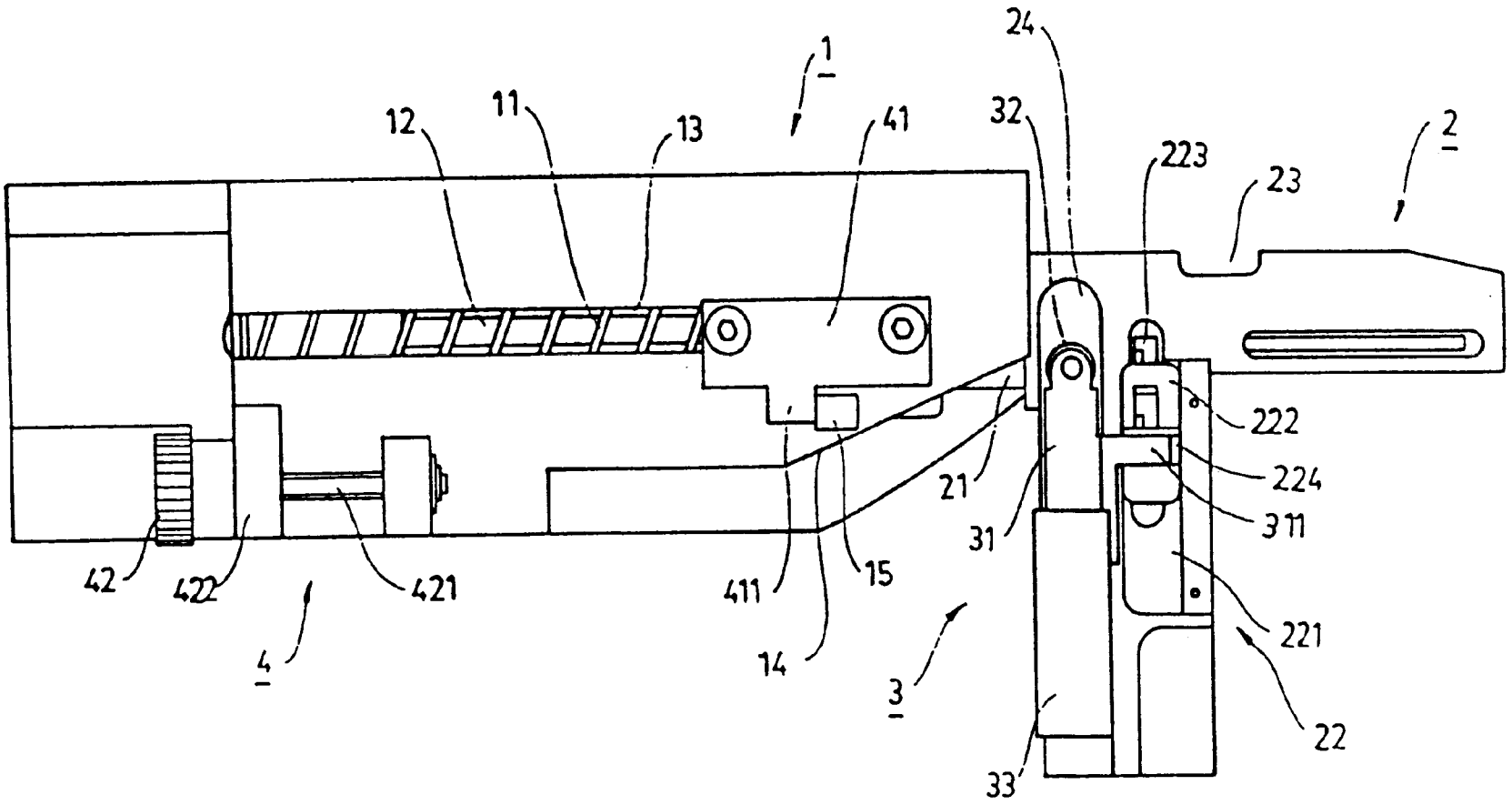
FIG. 3 is a schematic view of an improved structure of a screw-mounting device of the present invention.

Referring to FIG. 3, there is shown an improved structure of a screw-mounting device, comprising a machine body 1, a machine tubing 2, a pushing-control module 3 having a sliding wheel 32 and a retractable adjusting device 4 having a sliding block 41. The interior of the machine body 1 is similar to at of a conventional screw-mounting device and is provided with a spring 11 and a screw rod 12. The rear end of the screw rod 12 is corrected to a power member, which can rotate the screw rod 12. One end of the spring 11 is connect to amounting seat 21 of the machine tubing 2. The two sides of the machine body 1 are respectively provided with a passage 13, corresponding to each other, and one lateral side of the passage 13 is used for the mounting of the retractable adjusting device 4. The front end, and the bottom edge of the lateral side are provided with a tilting side 14, and the tilting side 14 is adapted for the sliding wheel 32 of the pushing-control module 3. The machine tubing 2 is extended at the front end of the machine body 1, and the rear end thereof is connected to the mounting seat 21, which is located within the interior of the machine body 1. The mounting seat 21, corresponding to a lateral side of the passage 13, is provided with a plurality of screw holes for the disposing of the sliding block 41 of the retractable adjusting device 4. Further, the bottom section of the machine tubing 2 is downwardly extended to form a screw-insertion module 22 to provide mounting of a screw block. The top portion of the machine tubing 2 located at the lateral side of the screw-insertion module 22, is provided with a through hole 23 for the extension of the plastic screw belt after the screws have been mounted. The sliding slot 221 of the screw-insertion module 22 is provided with a sliding block 222 and the sliding block 222 is provided with a screw-pushing plate 223 for the urging of the screws of the screw block The lower section of the screw-pushing plate 223 is provided with a recess 224 for the positioning of the holding block 311 of the pushing/controlling module 3. The pushing/controlling module 3 is located at the lateral side of the screw insertion slot module 22 and comprises guiding rod 31, a sliding wheel 32, and a cavity body 33. The guiding rod 31 is a rounded rod body having a side way protruded shaped holding block 311 mounted at the recess 224. The top of the guiding rod 31 is pivotally mounted with the sliding wheel 32 and the sliding wheel 32 is correspondingly mounted at the recess 24 of the machine tubing 2. When the machine tubing 2 is retracted backwards the sliding wheel 32 urgingly slides along the sloping side 14. However, the bottom section of the guiding rod 31 is provided with a spring located at the cavity body 33, and the cavity body 33 is used for the mounting of the spring connected the sliding rod 31 and the bottom section thereof. Thus, the sliding wheel 32, corresponding to the urgingly sliding of the sloping side 14, causes the guiding rod 31 to elevate or to descend accordingly, and the holding block 311 drives the entire sliding block 222 to elevate or to descend within the sliding slot 221 and in un, the screw-pushing plate 223 can urge the screws of the screw block In accordance with the present invention, the retractable adjusting device 4 comprise a sliding block 41, and a screw-adjusting rod 42, wherein the sliding block 41 is substantially a rectangular shape block which is mounted at the lateral side passage 13 of the mounting seat 21. The lower section of the sliding block 41 is extended to form a protruded block 41, to allow the blocking of the lateral side of the protruded body 15 of the machine body 1 such that the machine tubing 2 can appropriately extend to the front end of the machine body . In addition, the screw-adjusting rod 42 is also located at the side of the protruded body 15, and the rod 42 has a rotatable and adjustable screw rod 421 and a stopping block 422. The screw rod 421 can forwards or backwards so as to adjust the stopping block 422 and to change the position of the stopping block 422. Thereby, when the sliding block 41 moves backwards in accordance with the mounting seat to cause the protruded block 411 to urge with the stopping block 422, the distance of the machine tubing 2 is controlled to retract backwards so as to adjust the length of the screw for mounting.

Figure 4:
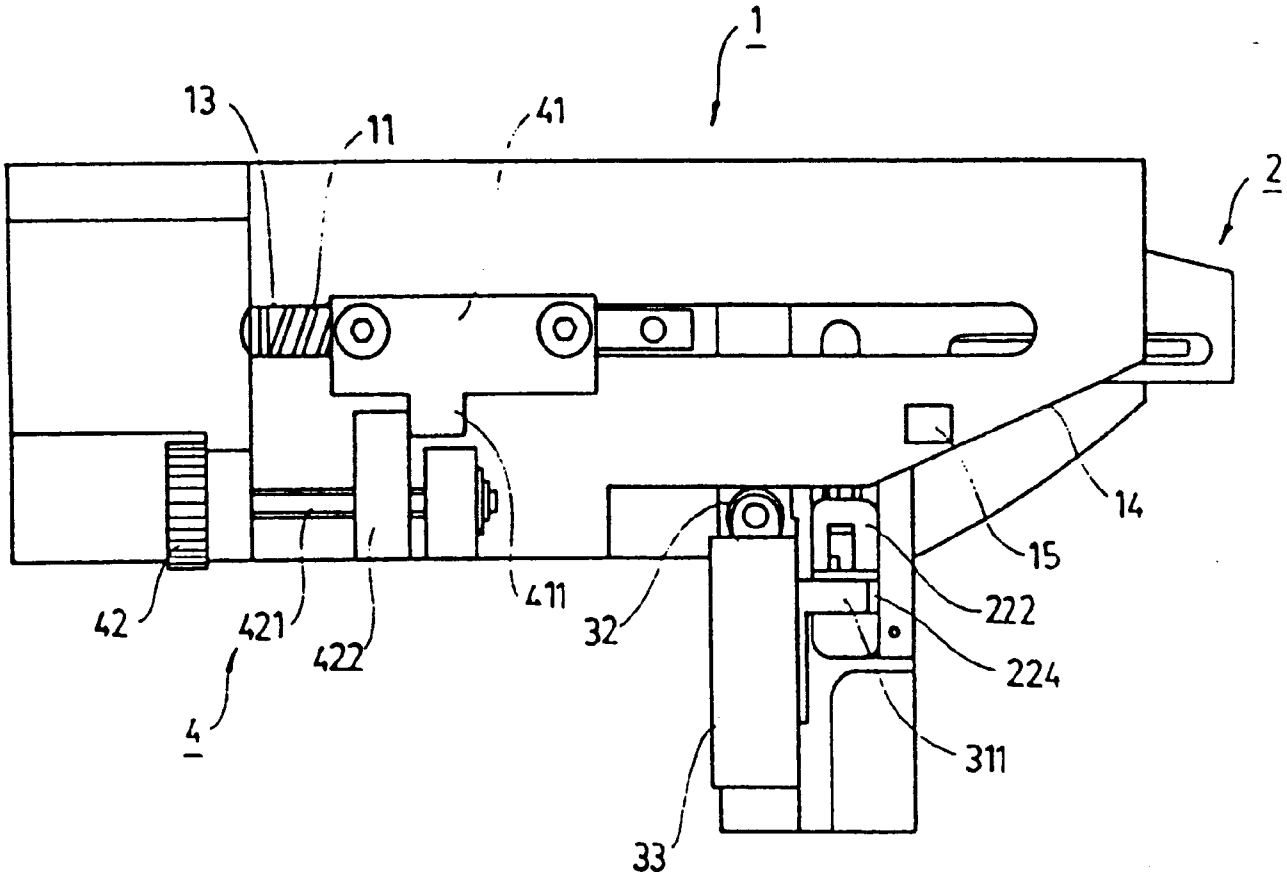
FIG. 4 is a schematic view showing the action of the pushing-controlling block in accordance with the present invention.

Referring to FIG. 4, the characteristics of the present invention are that the screw adjusting rod 42 of the retractable adjusting device 4 is appropriately adjusted in accordance with the length of the screw to be mounted, and the screw block is inserted into the screw-insertion slot module 22, and a force is exerted at the machine tubing 2 so as to cause the module 22 to react backwards. The mounting seat 21 simultaneously moves the sliding block 41 backwards such that the protruded block 411 urges the stopping block 422, and thus, the retractable distance of the machine tubing 2 is controlled in accordance with the length of the screw which is required to be mounted When the machine tubing 2 is retracted backwards, the sliding wheel 31 of the controlling module 3 is moved to the sloping side 14, and as the height becomes lower, the sliding rod 31 descends, and the holding block 311 causes the sliding block 222 to descend and the screw-pushing plate 223 slides across a screw and urges at the bottom section thereof.

When the screw has been mounted and the machine tubing 2 moves forwards, the sliding wheel 32 urges the sloping side 14 to move upwards. As the bottom section of the guiding rod 31 is provided with a spring and is located within the cavity body 33, the screw-pushing plate 223 elevates in accordance with the guiding rod 31 and the screw which is held by the screw-pushing rod 223 to move upwards. The screw is pushed to move upwards to the position where the screw rod 12 is positioned so as to await next mounting of the screw.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claim.

What is claimed is:

1. An improved structure of a screw mounting device comprising a machine body, a machine tubing, a controlling module and a retractable adjusting device located at one lateral side of the machine body, an end face of the machine body being a sloping side to allow a sliding wheel of the controlling module to urge against sliding movement, the controlling module comprising a guiding rod, the sliding wheel and a cavity body and the controlling module located at a side of a screw insertion slot module, characterized in that a lateral side of a sliding rod is extended to form a "⌐"shaped holding block, and the holding block is appropriately mounted at a recess located at a bottom section of a screw-pushing plate, the sliding wheel is pivotally mounted at a top section of the guiding rod, and a bottom section of the guiding rod is provided with a spring within the cavity body, thereby when the sliding wheel urgingly slides together with the sloping side, the guiding rod is simultaneously moved upwards or downwards according to the sloping side, so that the holding block drives a sliding block to move upwards or downwards within the sliding slot, and therefore the screw-pushing plate urges against a bottom section of a screw, and the screw is elevated until the screw rod is inserted for mounting, wherein the retractable adjusting device comprises a sliding block and a screw adjusting rod, and the sliding block is mounted at a mounting seat of the machine tubing, and a lower section of the sliding block of the retractable adjusting device is provided with a protruded block for blocking of forward movement urging at a protruded body of the machine body, or backward movement at a stopping block of the screw adjusting rod to allow adjustment of a retractable distance so as to match length of the screw to be mounted.

* * * * *